US008044863B2

(12) United States Patent
Ali et al.

(10) Patent No.: US 8,044,863 B2
(45) Date of Patent: Oct. 25, 2011

(54) LOW PROFILE, FOLDED ANTENNA ASSEMBLY FOR HANDHELD COMMUNICATION DEVICES

(75) Inventors: Shirook M. Ali, Mississauga (CA); Houssam Kanj, Waterloo (CA)

(73) Assignee: Research In Motion Limited, Ontario (CA)

( * ) Notice: Subject to any disclaimer, the term of this patent is extended or adjusted under 35 U.S.C. 154(b) by 546 days.

(21) Appl. No.: 12/323,664

(22) Filed: Nov. 26, 2008

(65) Prior Publication Data

US 2010/0127938 A1 May 27, 2010

(51) Int. Cl.
*H01Q 5/00* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 5,547,100 | A | 8/1996 | Johnson | |
| 5,633,646 | A | 5/1997 | Strickland | |
| 6,593,887 | B2 | 7/2003 | Luk et al. | |
| 6,950,071 | B2 | 9/2005 | Wen et al. | |
| 7,023,387 | B2 | 4/2006 | Wen et al. | |
| 7,038,627 | B2 | 5/2006 | Ikuta et al. | |
| 7,283,097 | B2 | 10/2007 | Wen et al. | |
| 7,352,328 | B2 | 4/2008 | Moon et al. | |
| 7,369,089 | B2 | 5/2008 | Wen et al. | |
| 7,400,300 | B2 | 7/2008 | Qi et al. | |
| 7,403,165 | B2 | 7/2008 | Qi et al. | |
| 7,619,571 | B2 * | 11/2009 | Vesterinen | 343/702 |
| 2004/0085245 | A1 | 5/2004 | Miyata et al. | |
| 2007/0109204 | A1 | 5/2007 | Phillips et al. | |
| 2008/0062058 | A1 | 3/2008 | Bishop | |
| 2008/0231530 | A1 | 9/2008 | Rao et al. | |
| 2008/0284661 | A1 | 11/2008 | He | |
| 2008/0287171 | A1 | 11/2008 | Qi et al. | |

FOREIGN PATENT DOCUMENTS

| | | | |
|---|---|---|---|
| EP | 1077505 | A2 | 2/2001 |
| EP | 1162688 | A1 | 12/2001 |
| JP | 20080167393 | | 7/2008 |
| WO | 2004015810 | A1 | 2/2004 |
| WO | 2008001169 | A2 | 1/2008 |

(Continued)

OTHER PUBLICATIONS

Chuo, et al.; Investigations of Isolation Improvement Techniques for Multiple Input Multiple Output (MIMO) WLAN Portable Terminal Applications; Progress in Electromagnetics Research, PIER 85, 349-366, 2008.

(Continued)

*Primary Examiner* — Jacob Y Choi
*Assistant Examiner* — Shawn Buchanan
(74) *Attorney, Agent, or Firm* — Hamilton & Terrile, LLP

(57) ABSTRACT

An antenna assembly is formed on a rectangular polyhedron support that has two sections projecting away from opposite sides of an electrically non-conductive substrate. An electrically conductive stripe wraps around the support and comprises a plurality of segments on different surfaces of the support. A conductive patch is located on two surfaces of the support to provide impedance matching between the antenna and a radio frequency circuit. By placing sections of the antenna assembly on both sides of the substrate and wrapping the conductive stripe around those sections, the space required to accommodate the antenna assembly within a housing of a communication device is reduced, as compared to some prior antenna designs.

18 Claims, 4 Drawing Sheets

FOREIGN PATENT DOCUMENTS

| | | | |
|---|---|---|---|
| WO | 2008001169 | A3 | 1/2008 |
| WO | 2008049354 | A1 | 5/2008 |

OTHER PUBLICATIONS

Kim, et al.; High Isolation Internal Dual-Band Planar Inverted-F Antenna Diversity System with Band-Notched Slots for MIMO Terminals; Department of Electrical Engineering Korea Advanced Institute of Science and Technology (KAIST), 373-1 Guseong-Dong, Yuseong-Gu, Taejeon, 305-701, Korea.

Karaboikis, et al.; Compact Dual-Printed Inverted-F Antenna Diversity Systems for Portable Wireless Devices; IEEE Antennas and Wireless Propagation Letters, vol. 3, 2004.

Waldschmidt and Wiesbeck; Compact Wide-Band Multimode Antennas for MIMO and Diversity; IEEE Transactions on Antennas and Propagation; vol. 52, No. 8, Aug. 2004.

Svantesson; Correlation and Channel Capacity of MIMO Systems Employing Multimode Antennas; IEEE Transactions on Vehicular Technology, vol. 51, No. 6, Nov. 2002.

Forenza et al; Benefit of Pattern Diversity via Two-Element Array of Circular Patch Antennas in Indoor Clustered Mimo Channels; IEEE Transactions on Communications, vol. 54, No. 5, May 2006.

Vaughan; Two-Port Higher Mode Circular Microstrip Antennas; IEEE Transactions on Antennas and Propagation, vol. 36, No. 3, Mar. 1988.

International Search Report and Written Opinion for PCT Application No. PCT/CA2009/001675, mailed Feb. 3, 2010.

International Preliminary Report of Patentability for PCT Application No. PCT/CA2009/001675, mailed Jun. 9, 2011.

International Search Report and Written Opinion mailed Feb. 3, 2010 for PCT/CA2009/001675.

Svantesson; Correlation and Channel Capacity of MIMO Systems Employing Multimode Antennas; IEEE Transactions on Vehicular Technology, vol. 51, No. 6, Nov. 2002.

Forenza and Heath; Benefit of Pattern Diversity via Two-Element Array of Circular Patch Antennas in Indoor Clustered MIMO Channels; IEEE Transactions on Communications, vol. 54, No. 5, May 2006.

Vaughan; Two-Port Higher Mode Circular Microstrip Antennas; IEEE Transactions on Antennas and Propagation, vol. 36, No. 3, Mar. 1988.

* cited by examiner

LOW PROFILE, FOLDED ANTENNA ASSEMBLY FOR HANDHELD COMMUNICATION DEVICES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE DISCLOSURE

1. Field of Technology

The present invention relates generally to antennas, and more specifically to multiple frequency band antennas that are particularly suited for use in wireless mobile communication devices, such as personal digital assistants, cellular telephones, and wireless two-way email communication devices.

2. Description of the Related Art

Different types of wireless mobile communication devices, such as personal digital assistants, cellular telephones, and wireless two-way email communication apparatus are available. Many of these devices are intended to be easily carried on the person of a user, often fitting in a shirt or coat pocket.

The antenna assembly configuration of a mobile communication device can significantly affect the overall size or footprint of the device. For example, cellular telephones typically have antenna assembly structures that support communication in multiple operating frequency bands, such as GSM 800 MHz/900 MHz/1800 MHz/1900 MHz bands, UMTS 2100 MHz band, and communication in the 5 GHz band. In addition the mobile communication device often is capable of interfacing with peripheral equipment using the 2450 MHz band and wireless technology such as Bluetooth® (registered trademark of Bluetooth Sig, Inc., Bellevue, Wash., USA). Various types of antenna for mobile devices are used, such as helical, "inverted F", folded dipole, and retractable antenna assembly structures, for example. Helical and retractable antenna are typically installed outside a mobile device, and inverted F antenna are usually located inside of a case or housing of a device. Generally, internal antenna are used instead external antenna for mobile communication devices for mechanical and ergonomic reasons. Internal antenna are protected by the case or housing of the mobile device and therefore tend to be more durable than external antenna. External antenna also may physically interfere with the surroundings of a mobile device and make a mobile device difficult to use, particularly in limited-space environments.

In some types of mobile communication devices, however, known internal structures and design techniques provide relatively poor communication signal radiation and reception, at least in certain operating positions. One of the biggest challenges for mobile device design is to ensure that the antenna assembly operates effectively for various applications, which determines antenna assembly position related to human body. Typical operating positions of a mobile device include, for example, a data input position, in which the mobile device is held in one or both hands, such as when a user is entering a telephone number or email message; a voice communication position, in which the mobile device may be held next to a user's head and a speaker and microphone are used to carry on a conversation; and a "set down" position, in which the mobile device is not in use by the user and is set down on a surface, placed in a holder, or held in or on some other storage apparatus. In these positions, parts of a users body and other ambient objects can block the antenna assembly and degrade its performance. Known internal antennas, that are embedded in the device housing, tend to perform relatively poorly, particularly when a mobile device is in a voice communication position. Although the mobile device is not actively being employed by the user when in the set down position, the antenna assembly should still be functional at least receive communication signals.

The desire to maintain the configuration of the mobile communication device to a size that conveniently fits into a hand of the user, presents a challenge to antenna assembly design. This presents a tradeoff between the antenna assembly performance, which dictates a relatively larger size, and the available space for the antenna assembly within the device. Larger internal antenna assembly assemblies often directly affect the thickness of the mobile communication device.

Therefore, it is desirable to reduce the thickness of the antenna assembly so that the mobile communication device can be made as slim as possible.

DETAILED DESCRIPTION OF THE INVENTION

The present antenna assembly is specially adapted for use in mobile wireless communication devices, such as personal digital assistants, cellular telephones, and wireless two-way email communication devices, and for brevity those mobile wireless communication devices are referred to herein as "mobile devices" and individually as a "mobile device". Furthermore, the present antenna assembly will be described in the specific context of use as part of a cellular telephone.

Figure 1:
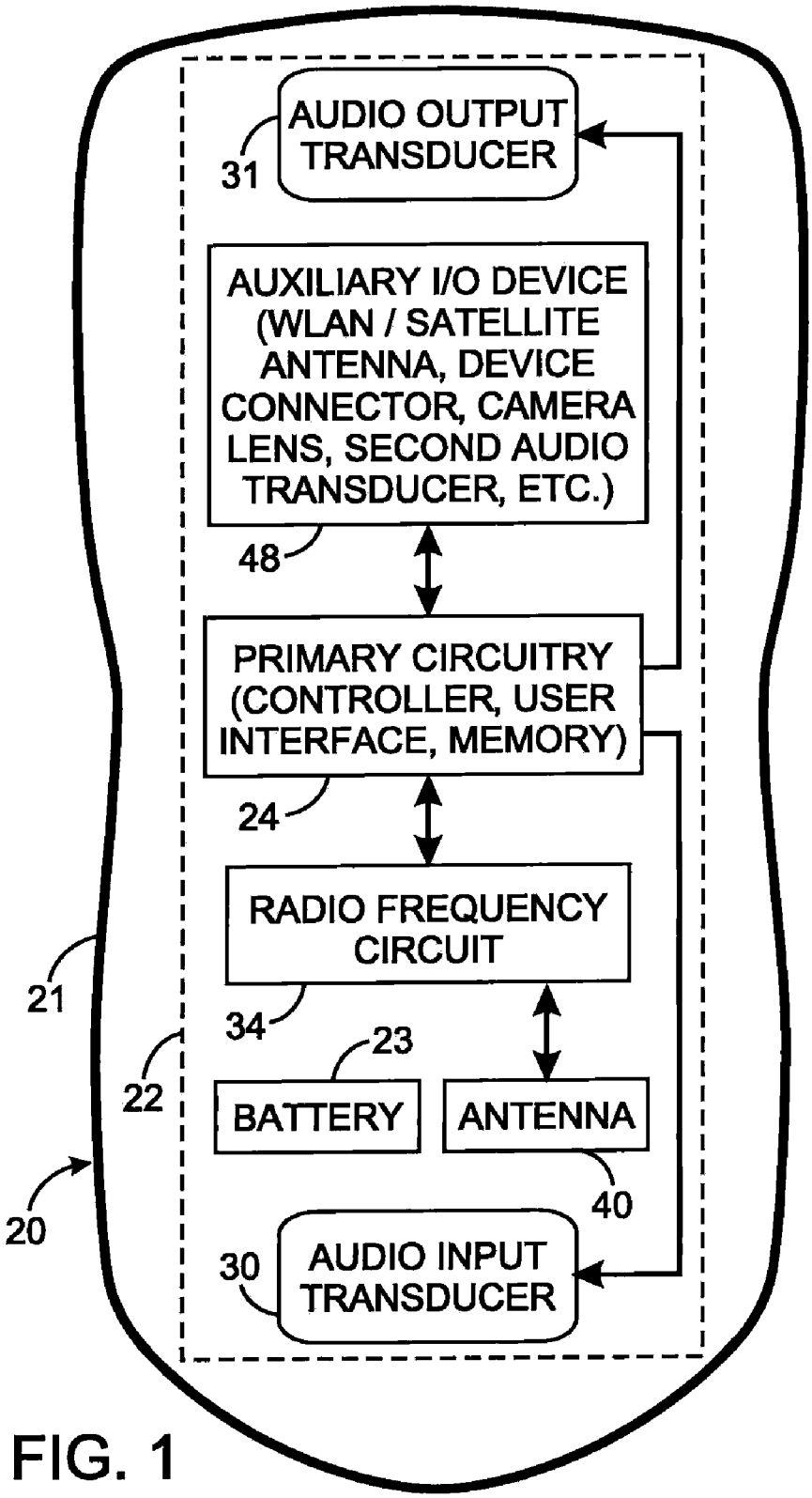
FIG. 1 is a schematic representation of a mobile wireless communication device.
Figure 2:
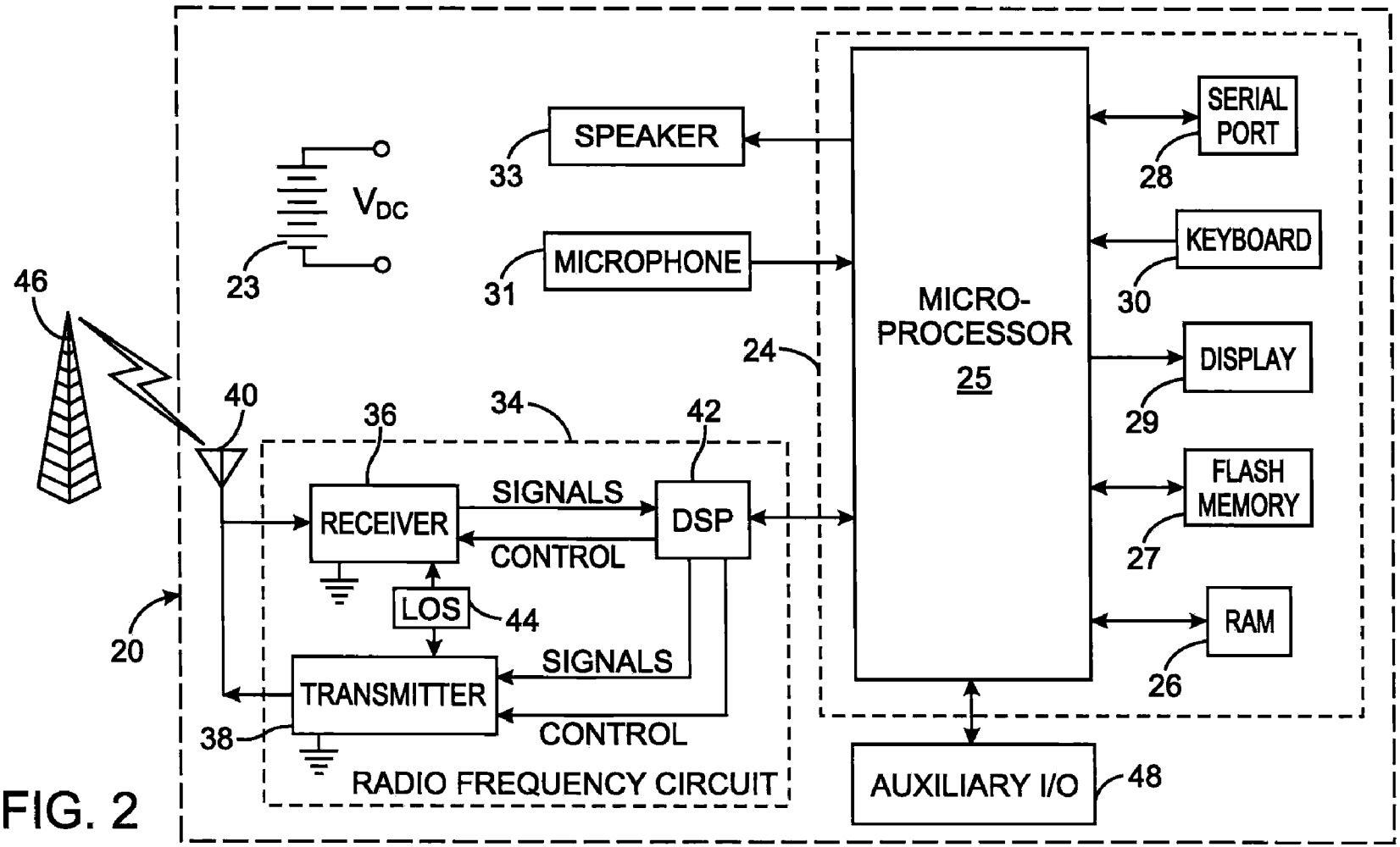
FIG. 2 is a schematic block diagram of the electronic circuitry for the mobile wireless communication device.

Referring initially to FIGS. 1 and 2, a mobile device 20, such as a mobile cellular device, illustratively includes a housing 21, which can be a static, a flip or sliding type housing similar to those used in many cellular telephones. Nevertheless, those and other housing configurations also may be used.

The housing 21 contains a main dielectric substrate 22, such as a printed circuit board (PCB) substrate, for example, on which is mounted the primary circuitry 24 for mobile device 20. That primary circuitry 24, as shown in greater detail in FIG. 2, typically includes a microprocessor 25, memory that includes a random access memory (RAM) 26 and a flash memory 27 which provides non-volatile storage. A serial port 28 constitutes a mechanism by which external devices, such as a personal computer, can be connected to the mobile device 20. A display 29 and a keyboard 30 provide a user interface for controlling the mobile device.

An audio input device, such as a microphone 31, and an audio output device, such as a speaker 33, function as an audio interface to the user and are connected to the primary circuitry 24. A battery 23 is carried within the housing 21 for supplying power to the internal components.

Communication functions are performed through a radio frequency circuit 34 which includes a wireless signal receiver 36 and a wireless signal transmitter 38 that are connected to a multiple frequency band antenna assembly 40. The antenna assembly 40 is carried within the lower portion of the housing 21 which advantageously increases the distance between the antenna assembly and the user's head when the phone is in use to aid in complying with applicable SAR requirements. The antenna assembly will be described in greater detail subsequently herein.

The radio frequency circuit 34 also includes a digital signal processor (DSP) 42 and local oscillators (LOs) 44. The specific design and implementation of the radio frequency circuit 34 is dependent upon the communication network in which the mobile device 20 is intended to operate. For example a device destined for use in North America may be designed to operate within the Mobitex™ mobile communication system or DataTAC™ mobile communication system, whereas a device intended for use in Europe may incorporate a General Packet Radio Service (GPRS) communication subsystem.

When required network registration or activation procedures have been completed, the mobile device 20 sends and receives signals over the communication network 46. Signals received by the multiple frequency band antenna assembly 40 from the communication network 46 are input to the receiver 36, which performs signal amplification, frequency down conversion, filtering, channel selection, and analog-to-digital conversion. Analog-to-digital conversion of the received signal allows the DSP 42 to perform more complex communication functions, such as demodulation and decoding. In a similar manner, signals to be transmitted are processed by the DSP 42 and sent to the transmitter 38 for digital-to-analog conversion, frequency up-conversion, filtering, amplification and transmission over the communication network 46 via the antenna assembly 40.

The mobile device 20 also may comprise one or auxiliary input/output devices 48, such as, for example, a WLAN (e.g., Bluetooth®, IEEE. 802.11) antenna assembly and circuits for WLAN communication capabilities, and/or a satellite positioning system (e.g., GPS, Galileo, etc.) receiver and antenna assembly to provide position location capabilities, as will be appreciated by those skilled in the art. Other examples of auxiliary I/O devices 48 include a second audio output transducer (e.g., a speaker for speakerphone operation), and a camera lens for providing digital camera capabilities, an electrical device connector (e.g., USB, headphone, secure digital (SD), or a memory card, etc.).

Structures for the antenna assembly 40 described herein are sized and shaped to tune the antenna assembly for operation in multiple frequency bands. In an embodiment of the invention described in detail below, the multi-band antenna assembly includes structures that are primarily associated with different operating frequency bands thereby enabling the antenna assembly to function as the antenna assembly in a multiple band mobile device. For example, a multiple-band antenna assembly 40 is adapted for operation at the Global System for Mobile communications (GSM) 900 MHz frequency band and the Digital Cellular System (DCS) frequency band. Those skilled in the art will appreciate that the GSM-900 band includes a 880-915 MHz transmit sub-band and a 925-960 MHz receive sub-band. The DCS frequency band similarly includes a transmit sub-band in the 1710-1785 MHz range and a receive sub-band in the 1805-1880 MHz. range. The antenna assembly 40 also functions in the Universal Mobile Telecommunications System (UMTS) 2100 MHz band and function in the 5 GHz band. The mobile device 20 also may be capable of interfacing with peripheral equipment using the Bluetooth® protocol in the 2450 MHz band. It will be appreciated by those skilled in the art that these frequency bands are for illustrative purposes only and the basic concepts of the present antenna assembly can be applied to operate in other pairs of frequency bands.

Figure 3:
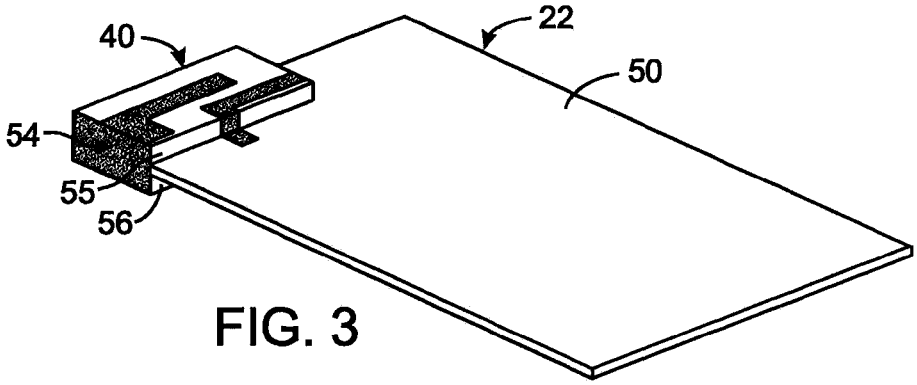
FIG. 3 is a perspective view from above a dielectric substrate on which an antenna assembly of the communication device is mounted.
Figure 4:
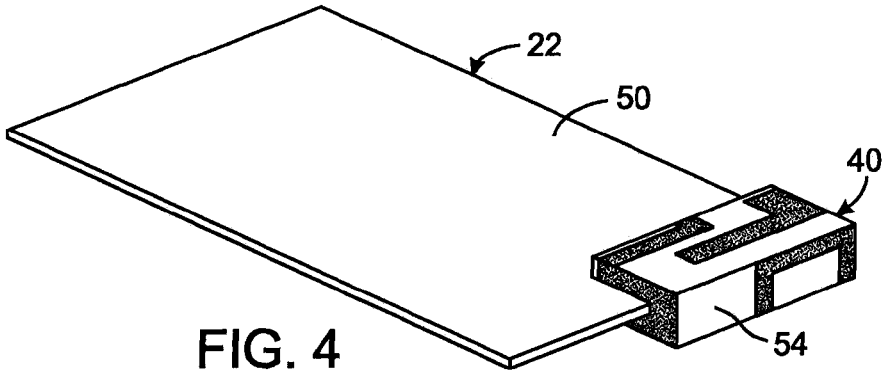
FIG. 4 is another perspective view from above a dielectric substrate.
Figure 5:
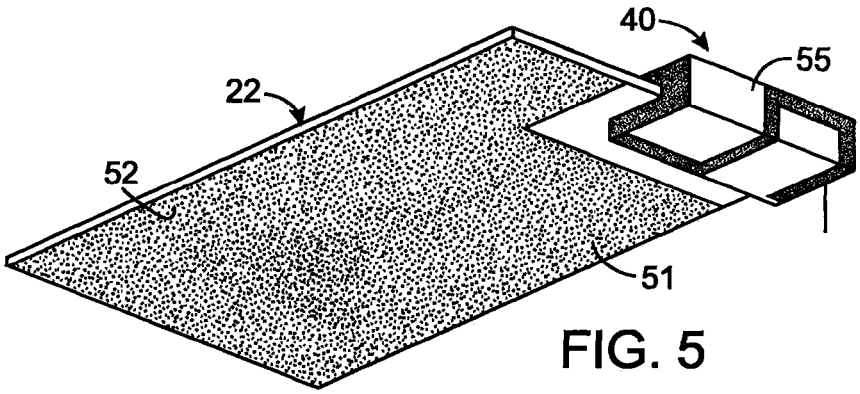
FIG. 5 is a perspective view from below the dielectric substrate.

With reference to FIGS. 3, 4 and 5, the electrically non-conductive substrate 22 on which the electronic circuitry for the mobile device is formed comprises a flat sheet of dielectric material of a type conventionally used for printed circuit boards. The dielectric substrate may be made of FR-4 laminate, which is a continuous glass-woven fabric impregnated with an epoxy resin binder. For example, the dielectric substrate is 1.5 mm thick and has a length and width that are dictated by the size of the mobile device housing 21 and the components of the device. Instead of being flat, the dielectric substrate 22 may be contoured to fit the interior shape of the housing 21. The dielectric substrate 22 has a first major surface 50 with one or more layers of conductive patterns to which circuit components are connected by soldering, for example. An opposite second major surface 51 of the dielectric substrate 22 has a layer 52 of conductive material, such as copper, applied thereto. The conductive layer 52 extends over the majority of the second major surface 51, except for a portion that is adjacent the antenna assembly 40 mounted at one corner of the dielectric substrate 22. The conductive layer 52 forms a ground plane for the mobile device 20.

The multiple frequency antenna assembly 40 comprises specific electrically conductive patterns on surfaces of a rectangular polyhedron which forms the support 54 of the antenna assembly. In one embodiment, the antenna assembly support 54 is constructed of a dielectric material similar to that of the substrate 22. The substrate 22 is sandwiched between two portions 55 and 56 of the rectangular polyhedron support 54. As an example of a specific configuration, the rectangular polyhedron support 54 is 7.5 mm high including the thickness of the substrate 22 wherein each portion 55 and 56 of the support extends 3.0 mm away from the respective surface 50 and 51 of the 1.5 mm thick substrate 22. In this example, the antenna assembly support 54 a solid body that is approximately 20 mm long and 9 mm wide with a slot into which the dielectric substrate 22 is secured. Alternatively, the antenna assembly support 54 is hollow being fabricated of panels of dielectric material that are 1.5 mm thick and secured together at their edges and to the major surfaces 50 and 51 of the dielectric substrate 22 using appropriate means, such as an adhesive.

Figure 6:
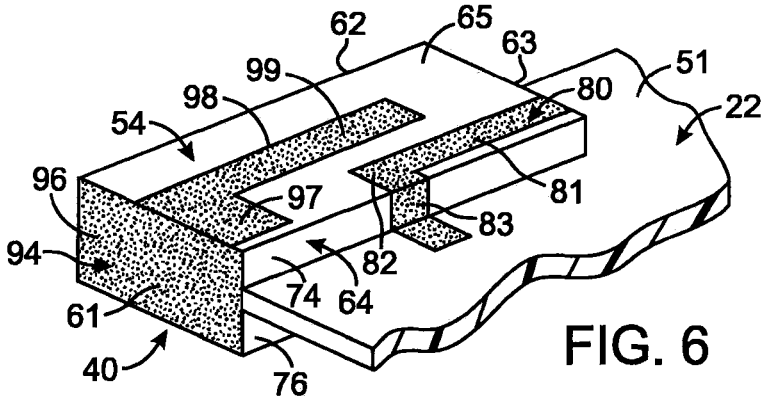
FIG. 6 is an enlarged perspective view from a first angle, showing three surfaces of a support on which the antenna assembly is formed.
Figure 7:
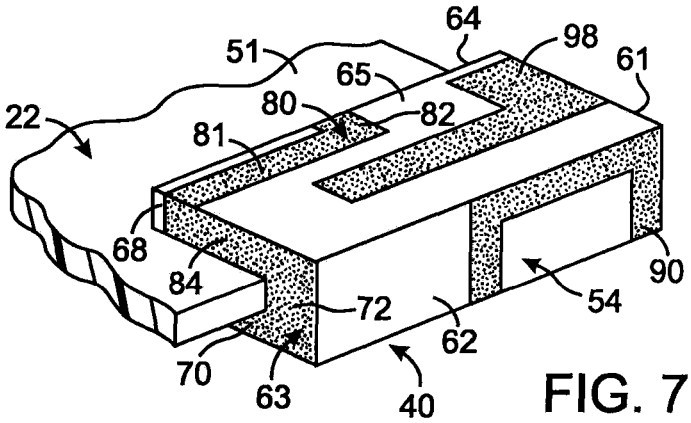
FIG. 7 is an enlarged perspective view from a second first angle showing the details of three surfaces of the support.
Figure 8:
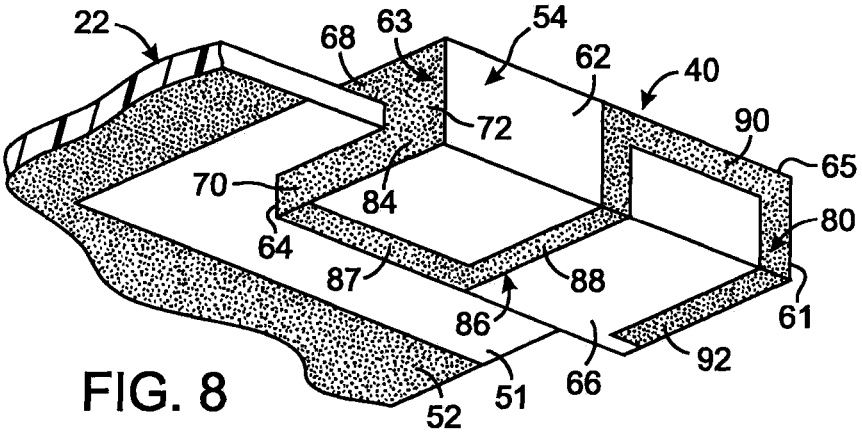
FIG. 8 is an enlarged perspective view from beneath the dielectric substrate and the support.

With reference to FIGS. 6-8, the six-sided rectangular polyhedron support 54 has a first side 61, a second side 62, a third side 63, and a fourth side 64, all of which extend between a fifth side 65 and a sixth side 66. The fifth side 65 is spaced from and parallel to the first major surface 50 of the dielectric substrate 22 and the sixth side 66 is spaced from and parallel to the second major surface 51. The antenna assembly support 54 may be located at one corner of the dielectric substrate 22 with the first and second sides 61 and 62 being flush with and incorporating a portion of two edges of that substrate. The major surfaces of the substrate 22 abut the third side 63 of the support, thereby defining a first section 68 of that side which is adjacent to and extends away from the first major surface 50 and defining a second section 70 adjacent to and extending away from the second major surface 51, as specifically seen in FIGS. 7 and 8. A link section 72 of the third side 63 connects the first and second sections 68 and 70. In a similar manner, the major surfaces of the substrate 22 extend across the entire length of the fourth side 64 dividing that side into a third section 74 and a fourth section 76, as shown in FIG. 6. The third section 74 of the fourth side 64 abuts and extends away from the first major surface of the dielectric substrate 22, while the fourth section 76 abuts and extends away from the second major surface 51. If the support 54 is hollow, the fourth side of the support is open on one or both sides of the dielectric substrate 22.

An electrically conductive stripe 80 forms an antenna element that wraps around the support 54 and comprises a plurality of segments on the different sides of that support. The conductive stripe and other conductive members are formed by applying a layer of conductive material, such as copper, to the entirety of the respective surface of the antenna assembly support 54 and then using a photolithographic process to etch away the conductive material from areas of that surface where a conductive part is not desired.

Referring to FIGS. 6 and 7, the conductive stripe 80 has a straight first segment 81 on the fifth side 65 and extending parallel and adjacent to the fourth side 64 from an end 82 at approximately the midpoint of length of the fifth side to an edge which abuts the third side 63. The end 82 of the first segment 81 is connected by a terminal strip 83 that extends across the third section 74 of the fourth side 64 and onto the first major surface 50 of the dielectric substrate 22. This terminal strip 83 provides a feed connection by which the antenna assembly is connected to the radio frequency circuit 34 in FIG. 2. If the fourth side of the support is open, a wire or other conductor is used to electrically connect the end 82 of the first segment 81 to the radio frequency circuit 34 on the dielectric substrate 22.

At the edge between the third and fifth sides 63 and 65 of support 54 as seen in FIGS. 7 and 8, the first segment 81 of conductive stripe 80 is connected to one end of a U-shaped second segment 84 on the third side. Specifically, the second segment 84 extends along the first section 68, the link section 72, and the second section 70 of the third side 63 of the support 54. At the opposite end of the U from connection to the first segment 81, the second segment 84 is coupled to a third segment 86 that is applied to the sixth side 66 (see FIG. 8). The third segment 86 has an L-shape comprising a first leg 87 that extends from the connection to the second segment 84 along the edge of the sixth side 66 which abuts the fourth side 64 to approximately a mid-point along the length of the sixth side. At that mid-point, a second leg 88 of the third segment 86 extends orthogonally from the first leg 87 terminating at the edge of the sixth side 66 that abuts the second side 62.

At that latter edge shown in FIG. 8, the third segment 86 is connected to a fourth segment 90 which is on the second side 62 of the antenna assembly support 54. The fourth segment 90 has a U-shape, which as in the illustrated orientation of the device is an inverted U-shape. One end of this U is connected to the terminus of the second leg 88 of the third segment 86 and extends upward to the edge of the second side 62 that abuts the fifth side 65. From that point, the fourth segment 90 extends along the second side edge to another edge that abuts the first side 61, at which point the fourth segment turns downward terminating at the edge of the second side 62 that abuts the sixth side 66. From that terminus of the fourth segment 90, the conductive stripe 80 continues with a fifth segment 92 that is applied to the sixth side 66 and which extends parallel to the second leg 88 of the third segment 86. The conductive stripe 80 terminates at opposite end of the fifth segment 92.

Referring again to FIGS. 6 and 7, an electrically conductive patch 94 is applied to the first and fifth sides 61 and 65 respectively. The patch 94 includes a rectangular conductive area 96 comprising the entire surface of the first side 61. That conductive area 96 is connected to an L-shaped strip 98 of the patch 94 on the fifth side 65. The L-shaped strip 98 has a first leg 97 that extends along a common edge between the first and fifth sides 61 and 65 and is connected to the conductive area 96. A second leg 99 of the L-shaped strip 98 extends from the first leg 97 orthogonally to the common edge. The rectangular conductive area 96 of the patch 94 also is electrically connected to the fourth segment 90 at the edge where the first and second surfaces abut, and to the fifth segment 92 at the edge at which the first and sixth surfaces abut. The patch 94 improves the impedance matching of the antenna at low and high frequency bands. The location and size of the patch 94 are chosen to optimize the antenna performance and to regain the impedance match after reducing the effective antenna height by folding the antenna around the dielectric substrate 22.

Thus the present antenna assembly 40 has sections on both sides of the dielectric substrate 22 on which other components of the electronic circuit are mounted. Dividing the antenna assembly in that manner reduces the space required within the device housing 21 and thus the overall thickness of the mobile device 20, as compared to some prior designs. Nevertheless this unique antenna assembly 40, by wrapping the antenna element, provides an antenna that is sized to operate over a plurality of frequency bands.

The foregoing description was primarily directed to one embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention claimed is:

1. An antenna assembly for a mobile wireless communication device comprising: a substrate of electrically non-conductive material having a first major surface and a second major surface; a support abutting the substrate and having a first side, a second side, a third side and a fourth side all extending between a fifth side and a sixth side, wherein the support has a first portion abutting and projecting away from the first major surface and has a second portion abutting and projecting away from the second major surface; and an electrically conductive element having conductive segments on a plurality of sides of the support frame; wherein the electrically conductive element comprises a first segment on the fifth side and extending parallel to the fourth side, a second segment on the third side and connected to the first segment, a third segment on the sixth side and connected to the second segment, a fourth segment on the second side and connected to the third segment, and a fifth segment on the sixth side and connected to the fourth segment; wherein the second segment has a U-shape extending around an edge of the substrate between the first and second major surfaces, and having one end connected to the first segment and another end connected to the third segment.

2. The antenna assembly as recited in claim 1 wherein the third segment of the electrically conductive element has an L-shape with one end connected to the second segment and another end connected to the fourth segment.

3. The antenna assembly as recited in claim 1 wherein the fourth segment has a U-shape with one end connected to the third segment and another end connected to the fifth segment.

4. The antenna assembly as recited in claim 1 further comprising an electrically conductive patch on the fifth side.

5. The antenna assembly as recited in claim 1 further comprising an electrically conductive patch on the first side.

6. The antenna assembly as recited in claim 1 further comprising an electrically conductive patch comprising a conductive area on the first side and connected to an L-shaped conductive area on the fifth side.

7. The antenna assembly as recited in claim 1 wherein the third side of the support has a first section on one side of the substrate and a second section on an opposite side of the substrate, and the second segment covers substantially all exposed areas of the third side.

8. The antenna assembly as recited in claim 1 further comprising a terminal strip on the support and connected proximate to one end of the electrically conductive element for coupling to a radio frequency circuit.

9. The antenna assembly as recited in claim 1 wherein the support is solid.

10. The antenna assembly as recited in claim 1 wherein the substrate further comprises a layer of electrically conductive material on a portion of the second major surface and spaced from the support.

11. An antenna assembly for a mobile wireless communication device comprising: a substrate of electrically non-conductive material having a first major surface and a second major surface, and having a layer of conductive material on a first portion of the second major surface; a support having a first side, a second side, a third side and a fourth side all of which extend between a fifth side and a sixth side, wherein the substrate abuts the support thereby dividing the third side into a first section on one side of the substrate adjacent the first major surface and a second section on an opposite side of the substrate adjacent the second major surface, and dividing the fourth side into a third section adjacent the one side of the substrate and a fourth section adjacent the opposite side of the substrate; and an electrically conductive stripe on sides of the support and comprising a first segment on the fifth side and extending from and orthogonal to an edge of the third side, a second segment on both the first and second sections of the third side and connected to the first segment, a third segment on the sixth side and connected to the second segment, a fourth segment on the second side and connected to the third segment, and a fifth segment on the sixth side and connected to the fourth segment; and a conductive patch comprising a first conductive region on the first side and a second conductive region on the fifth side and connected to the first conductive region.

12. The antenna assembly as recited in claim 11 wherein second conductive region of the conductive patch has an L-shape with a first leg connected to the first section and a second leg extending from the first leg.

13. The antenna assembly as recited in claim 11 wherein the second segment has a U-shape with one end connected to the first segment and another end connected to the third segment.

14. The antenna assembly as recited in claim 11 wherein the second segment covers substantially all exposed areas of the third side of the support.

15. The antenna assembly as recited in claim 11 wherein the third segment of the electrically conductive stripe has an L-shape with one end connected to the second segment and another end connected to the fourth segment.

16. The antenna assembly as recited in claim 11 wherein the fourth segment has a U-shape with one end connected to the third segment and another end connected to the fifth segment.

17. The antenna assembly as recited in claim 11 further comprising a terminal strip on the support and connected to the first segment for coupling the electrically conductive stripe to a radio frequency circuit.

18. The antenna assembly as recited in claim 11 wherein the layer of conductive material on a portion of the second major surface is spaced from the support.

* * * * *